US012123212B2

(12) United States Patent
Paananen

(10) Patent No.: US 12,123,212 B2
(45) Date of Patent: Oct. 22, 2024

(54) POST SOCKET AND A METHOD TO MAKE A POST SOCKET

(71) Applicant: STAKETTA KY, Kumpumäki (FI)

(72) Inventor: Tuomo Paananen, Kumpumäki (FI)

( * ) Notice: Subject to any disclaimer, the term of this patent is extended or adjusted under 35 U.S.C. 154(b) by 242 days.

(21) Appl. No.: 17/747,447

(22) Filed: May 18, 2022

(65) Prior Publication Data

US 2022/0412116 A1 Dec. 29, 2022

(30) Foreign Application Priority Data

May 18, 2021 (FI) ..... 20215592

(51) Int. Cl.
*E04H 12/22* (2006.01)

(52) U.S. Cl.
CPC ..... *E04H 12/2269* (2013.01); *E04H 12/2215* (2013.01)

(58) Field of Classification Search
CPC ..... E04H 12/2269; E04H 12/2215
See application file for complete search history.

(56) References Cited

U.S. PATENT DOCUMENTS 225,683 A * 3/1880 Brady ..... E04H 12/2269 52/298
4,271,646 A * 6/1981 Mills ..... E04H 12/2215 52/165
4,588,157 A 5/1986 Mills
D382,736 S * 8/1997 Kopish ..... D25/126
8,276,345 B2 * 10/2012 Brady ..... E06B 3/9642 52/843
8,322,678 B2 * 12/2012 Zhu ..... E04H 17/22 248/516
2016/0060889 A1 * 3/2016 Tedesco ..... E04H 12/2238 52/514
2016/0097209 A1 * 4/2016 Angelo ..... E04G 23/0229 52/297
2016/0237712 A1 * 8/2016 Finnegan ..... E04H 12/2215
2017/0335590 A1 * 11/2017 Volin ..... E04H 12/2215
2019/0284828 A1 * 9/2019 Benton ..... E04H 12/2269
2022/0356724 A1 * 11/2022 Bergman ..... E04H 12/2284

FOREIGN PATENT DOCUMENTS

CA 2592234 A1 * 11/2008 ..... E02D 27/42
EP 0120643 A2 10/1984
EP 0150946 A2 8/1985
GB 2151273 A 7/1985

OTHER PUBLICATIONS

Search Report in Finnish Application No. 20215592, mailed on Dec. 14, 2021, 1 page.
Opinion on Patentability in Finnish Application No. 20215592, mailed Dec. 14, 2021, 4 pages.

* cited by examiner

*Primary Examiner* — Theodore V Adamos
(74) *Attorney, Agent, or Firm* — Koivula & Somersalo, LLC

(57) ABSTRACT

A socket for receiving a post and a method to make the socket is disclosed. The socket is formed of a multitude of socket wall parts that comprise at least one vertical bend forming a corner, and a flange formed along one vertical side of the wall. The socket wall parts are joined together by joining a flange of one wall part to a vertical side without a flange of the neighboring wall part, thus forming a socket where the flanges are pointing toward the interior of the socket and the outer surface of the socket is continuous.

18 Claims, 5 Drawing Sheets

POST SOCKET AND A METHOD TO MAKE A POST SOCKET

CROSS REFERENCES

This application claims priority of Finnish patent number 20215592 filed on May 18, 2021, the contents of which are incorporated herein by reference.

TECHNICAL FIELD

The specification relates to a post socket and a method to form such.

BACKGROUND

Post sockets are used for installing, for example, vertical posts of fences to the ground anchors. Typically, the post sockets are made of steel that has been treated against corrosion. If post sockets are to be directly attached to the ground, a wedge-shaped ground-protruding portion is accompanying a socket on its top. The pillar, the pole, or the post is inserted into the socket.

EP 0150946A2 discloses a post support comprising a post receiving box section and a ground engaging portion that is produced by forming the box section with slots at its lower end having dimensions appropriate closely to engage with one end of the ground engaging portion, introducing the ground engaging portion into the slot of the box section and welding the ground engaging portion into the slots, thus attaching the ground engaging portion rigidly to the box section.

U.S. Pat. No. 4,588,157A discloses a post support comprising an elongate ground engaging portion, preferably a cruciform cross section, capable of being driven vertically into the ground, and a post engaging portion attached to the ground engaging portion and in the form of a hollow box section for receiving one end of a post to be supported in a vertical position. Its axis is substantially parallel to the axis of the ground engaging portion. The hollow box section is formed with means, integral therewith, other than means for adjusting the size of the box section, for enabling an undersized post to be rigidly supported in the box section and/or for removing excess post material from an oversized post. Means for removing excess material from an oversized post may comprise a bevelled edge formed on the top surface of at least one wall of the box section to present a chisel edge to a post being driven into the box section. Means for enabling an undersized post to be rigidly supported in the box section preferably comprise an upstanding projection or plurality of projections on the inner surface of at least one wall of the box section whereby the interior dimensions of the box section are effectively reduced. Preferably the projections comprise vertical flanges produced by punching out a section of the wall of the box section and bending the punched section inwardly of the box section.

Ideally, the post socket should provide flanges to allow tolerance in the size of the wooden post on the one hand and rigidity on the other hand. Current solutions disclose bending a smooth socket from single sheet and then optionally die cutting or punching openings to the socket forming sheet walls to provide flanges. If the walls of the socket are smooth, openings are needed for fastening means. Therefore, several steps with different tools are required in the manufacturing process.

The optional flanges in the socket described above provide support only on a small portion of the wooden post inside the socket. Minimal contact surface between the socket flanges and the post make the attachment susceptible to local wear. In addition, openings on one or more sides of the socket enable water, and thereby ice, penetration into the socket and into the wooden post. Water and ice inside the socket and the post shorten the lifetime of the post and the accompanying fence.

SUMMARY

According to the present solution a new socket and a method to make the socket is provided. A socket with side flange for post attachment, is disclosed.

The socket is manufactured from two or more parts forming the socket walls and socket base. The socket walls are manufactured by bending each part about vertical axis to form two free ends and at least one corner of the wall. Each free end of the parts is arranged to extend to 20-80% of the total wall width in horizontal direction. One free end of each part is further bended about the vertical axis and in the same direction to form a flange. Parts are connected from unbent free end of one part to a root of the flange of another part so that flanges point towards interior of the socket.

A socket comprising socket walls and a socket base is disclosed, wherein the socket comprises socket walls and a socket base. The socket walls are formed from two or more parts, each part comprising two free ends and at least one corner. Each free end extends to 20-80% of a horizontal width of the socket and one free end comprises a further fold forming a flange. The two or more parts are connected such that unbent free end is connected to a root of a flange comprising end of another part so that the flanges are arranged to point towards interior of the socket.

BRIEF DESCRIPTION OF THE DRAWINGS

Next the product will be described in greater detail with reference to the accompanying drawings, in which.

Figure 1:
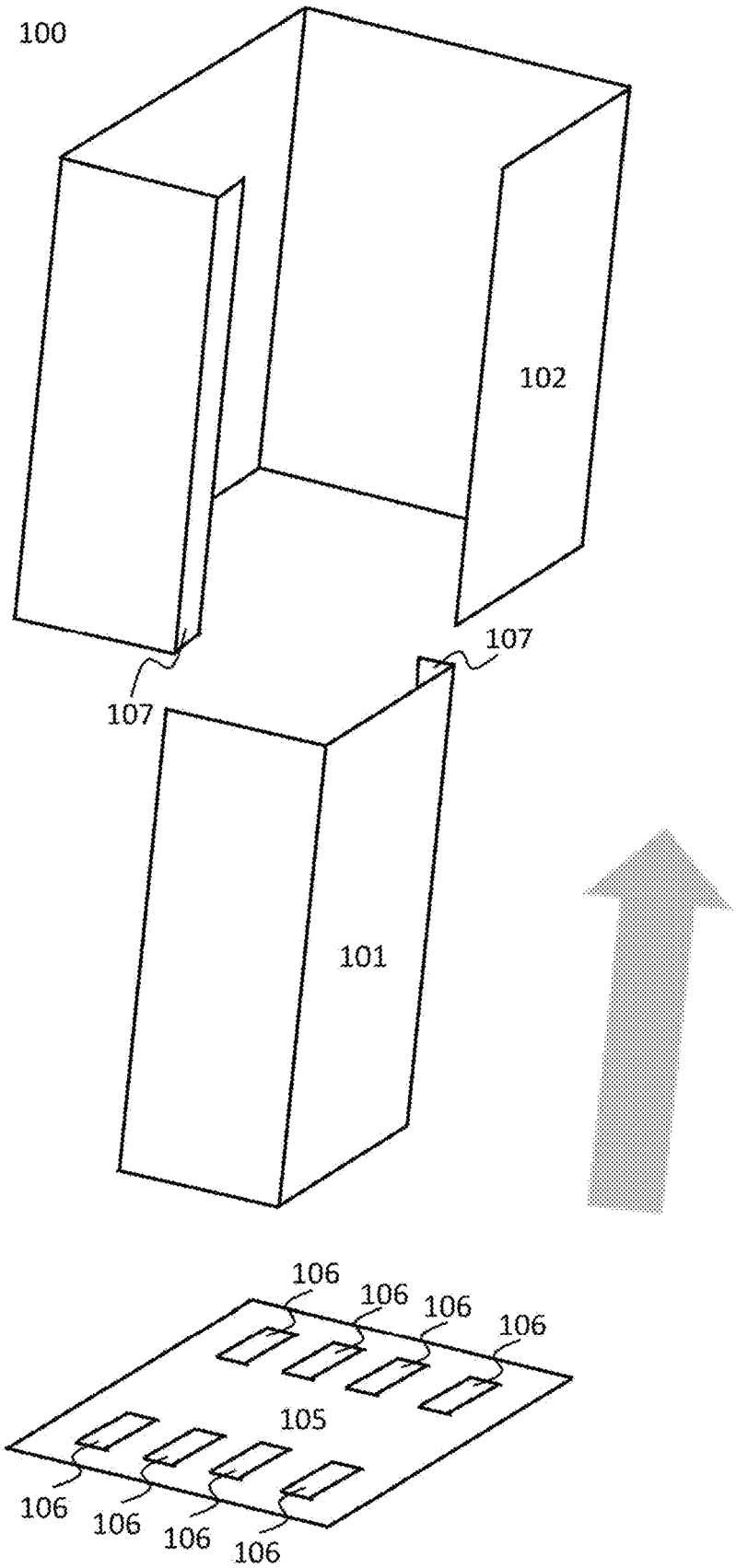
FIG. 1 is a schematic illustration of an embodiment on the assembly of the socket.

The figures are schematic. The figures are not in any particular scale.

DETAILED DESCRIPTION

In the context of the present solution socket may be a post socket. the socket may additionally include a ground engaging portion, such as a wedge. The socket may be a ground anchor or an upper part of a ground anchor. The socket may be driven vertically to ground to hold a post. The post may be a wooden post. The post may be a fence post or any other vertically erectable element. Horizontal direction of the socket may correspond to the width in x and y direction of the post that is arranged into the socket.

Current socket solutions for holding a post have one or more holes on the sides of the socket. Such holes may be manufactured if the socket material is thick enough. With thinner sheets, the holes on the sides and the length of the sides between edges of the corners allow the socket to lose its shape thus making it impossible to securely install the post. With the proposed approach, thinner sheets may be used, because instead of holes sacrificing the stiffness, an additional edge is formed on two or more sides of the socket (see FIGS. 1-4). These edges form the flanges. The assembly of the socket from two or more flange forming parts thus shortens the length of the sides between edges. The flanges support the structure as additional corner-like structures. Therefore, thinner sheets may be used to assemble the socket. The socket structure is reinforced by introducing two or more additional edges, flange corners, to the socket. With the method of this disclosure the thickness of the metal sheet may be less than 2 mm, for example 1.5-2.0 mm.

Current socket solutions for holding a post have one or more flanged holes in the sides of the socket. If the holes are elongated to the whole height of the socket wall, the length of the hole defines the height of the socket. One aspect of the presented socket is that the flange extends from the base of the socket to top of the socket. Therefore, for two sockets with the same height, the presented socket has flanges that support the post inserted into the socket for its entire height. This is especially important at the top end of the socket which often receives forces delivered from the post, when in use. Because the socket without flanges cannot have holes at the top end of the socket, it fails to provide such top end support. Even if the holes on a traditional socket were circular, the same top end support problem remains.

The flange extends the whole height of the socket. The width of the socket is preferably 10-15 mm. This improves the grip of a post to the socket. Because the flanges extend to the top end of the socket, they stabilize the post by preventing any gap to form between the post and top end of the socket. Because the post is often tall and only fixed to the ground, lots of stress or strain is targeted on a post-socket combination. Strain or momentum may be caused be, for example, cattle hitting a post, a post having hinges for a gate that opens, or a person leaning on a post. Any gap between the top end of the socket and the post may allow strain or momentum to cause movement in the post-socket combination and loosen the post from the socket.

The straight walls of the presented socket are not only aesthetically pleasing, the walls enable the socket to be installed with any of the walls facing the visible side during installation. The installation is easier, because one does not have to take care of the orientation of the installation. Furthermore, straight walls are safer because they don't have holes with sharp cut borders. Such borders may cause injuries and/or tear clothes.

Because there are no openings on any of the sides of the presented socket, water is prevented from entering the socket from the sides. Therefore, the socket is more resistant towards damages to the post by water, and especially ice. Should water enter the socket, openings are arranged to the base of the socket to enable exit of the water.

Figure 2:
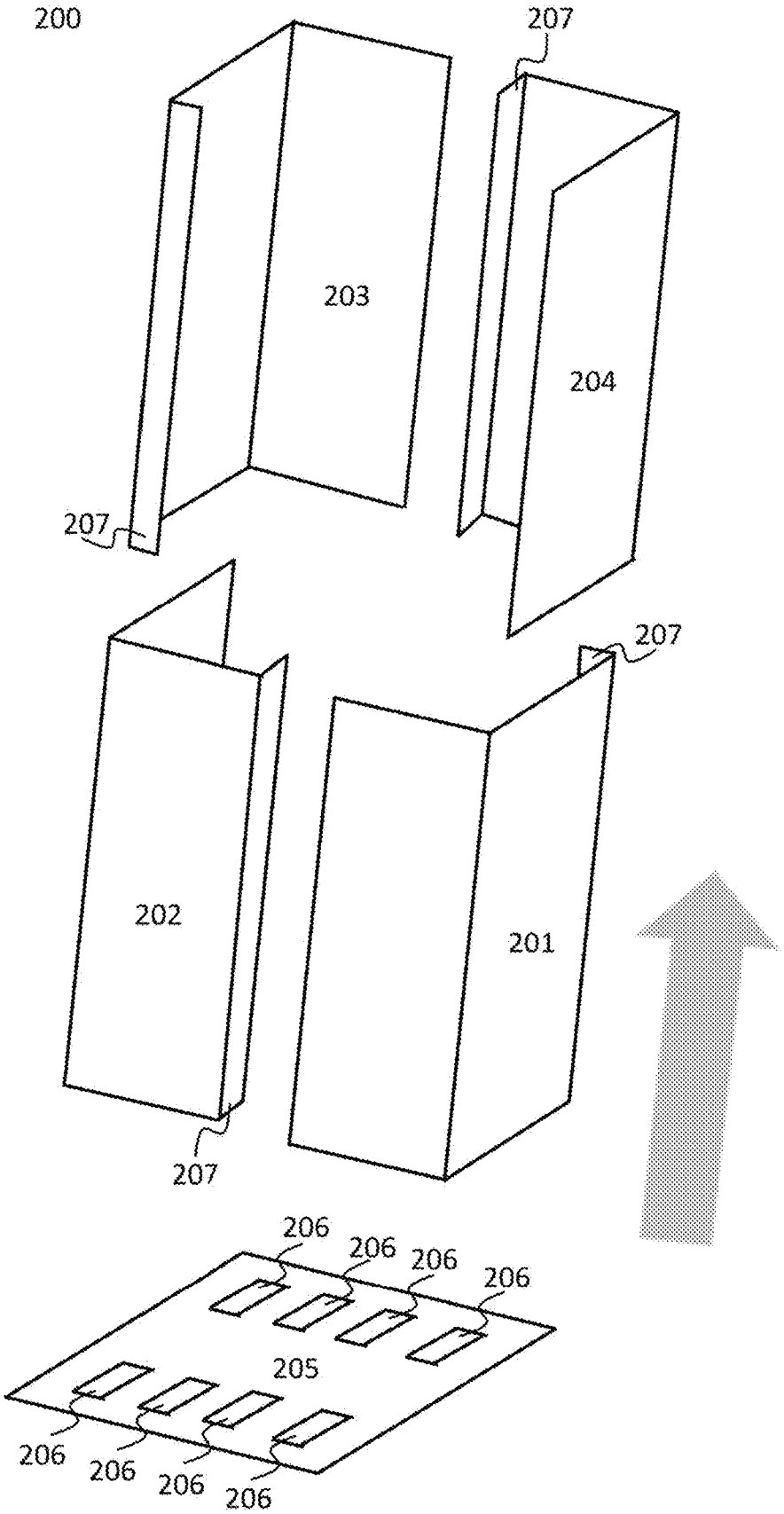
FIG. 2 is a schematic illustration of an embodiment on the assembly of the socket.

FIG. 1 is a schematic illustration of an embodiment on the assembly of the socket 100 assembled from two wall parts 101, 102 and a socket base 105. Openings 106 may be arranged to the socket base 105. FIG. 2 is a schematic illustration of an embodiment on the assembly of the socket 200 assembled from four wall parts 201, 202, 203, 204 and a socket base 205. Openings 206 may be arranged to the socket base 205.

Each of the parts 101, 102, 201, 202, 203, 204 is made from metal, for example zinc-coated steel, by bending or curving the part about vertical axis into an angle corresponding to the respective angle of the post. Commonly, the post material is a rectangular wood post and thus the bending angle of the part is about 90 degrees.

Each part 101, 102, 201, 202, 203, 204 is bent about vertical axis to form at least one corner of the wall. When bent vertically, each of the parts extend to at least two horizontal directions. Each of the angles between the horizontal dimensions correspond to the respective angles of the post intended to be positioned in the socket that is formed from the parts. Each of the angles between the horizontal dimensions may be 90 degrees. The vertical dimension may be the gravitational direction. The horizontal direction may orthogonal to the vertical direction.

Free ends are formed on both sides of the vertically bent angle of the part 101, 102, 201, 202, 203, 204. The free ends of the part 101, 102, 201, 202, 203, 204 are arranged to extend 20-80% of the total wall width in horizontal direction The inner diameter of the total wall width 100% may match approximately the width of the post. Parts 101, 102, 201, 202, 203, 204 are bent such that when connected they form a rectangular opening with the inner diameter of the opening sufficiently wide to receive the post.

One free end of the part 101, 102, 201, 202, 203, 204 is further bent about vertical axis to form a flange 107, 207. The bending is made to the same direction as the first bend so that the flange 107, 207 is formed towards to post receiving inner section of the socket.

Flanges 107, 207 on the inside of the anchor compensate for differences in the post size. Additionally, if the flanges 107, 207 tightly fit or even penetrate the surface of the post, they may be used to fasten the post without any additional or external fastening means.

If the socket is manufactured from two parts (FIG. 1), the first part 101 has one angle and one flange 107, and the second part 102 has three angles and one flange 107. The inner diameter of the bending is made such that the post fits inside the bended parts 101, 102, when the parts have been connected. The unbent free end of one part 101 is connected to a root of the flange 107 of another part 102 and the unbent free end of one part 102 is connected to a root of the flange 107 of another part 101. Socket base 105 is connected to the ground facing bottom of the connected parts 101, 102. The connection may be a welded connection.

If the socket is manufactured from four parts (FIG. 2), all the parts 201, 202, 203, 204 have one angle and one flange 207. The inner diameter of the bending is made such that the post fits inside the bended parts 201, 202, 203, 204, when the parts have been connected. The unbent free end of one part 201, 202, 203, 204 is connected to the root of the flange 207 of a neighbouring part 204, 203, 202, 201 and the unbent free end of one part 204, 203, 202, 201 is connected to a root of the flange 207 of a neighbouring part 201, 202, 203, 204. Socket base 205 is connected to the ground facing bottom of the connected parts 201, 202, 203, 204. The connection may be a welded connection.

The socket base 105, 205 may be a stopper for the post. The openings 106, 206 in the socket base 105, 205 allow water passage through the socket. Socket base 105, 205 openings 106, 206 may have flanges to enable tighter attachment of the posts. Additionally, the socket may be attached to rigid surface through the openings 106, 206 using additional fastening means. The rigid surface may be, for example, a concrete surface or a rock surface that cannot be penetrated by a wedge or a ground engaging portion.

Figure 3:
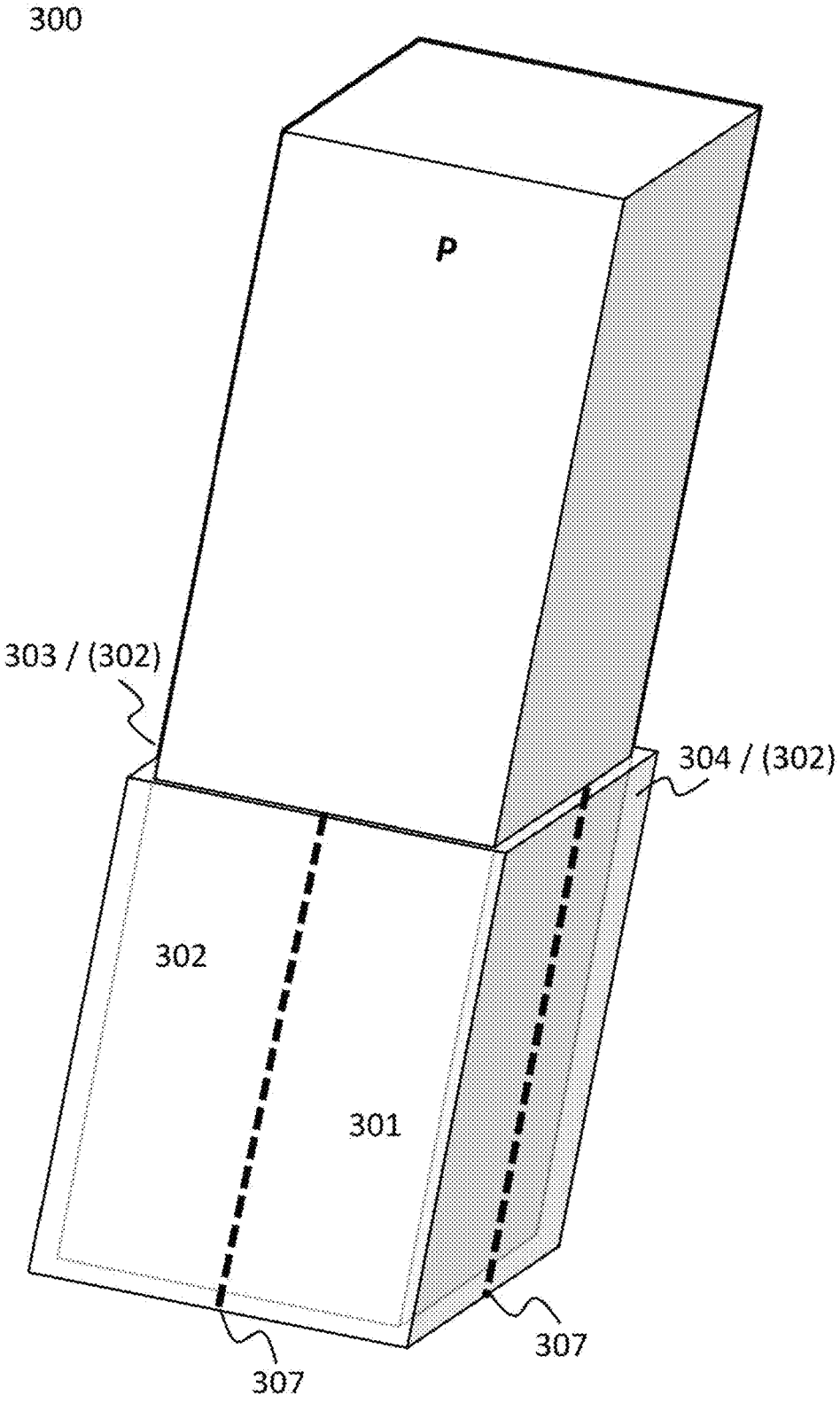
FIG. 3 is a schematic illustration of an embodiment on the assembly of the socket.

FIG. 3 is a schematic illustration of an embodiment on the assembly of the socket 300 with a post P inserted into the assembled socket. The socket may have been assembled from two 301, 302 or more wall parts 301, 302, 303, 304. Dashed lines indicate the location of the visible flanges 307.

Figure 4A:
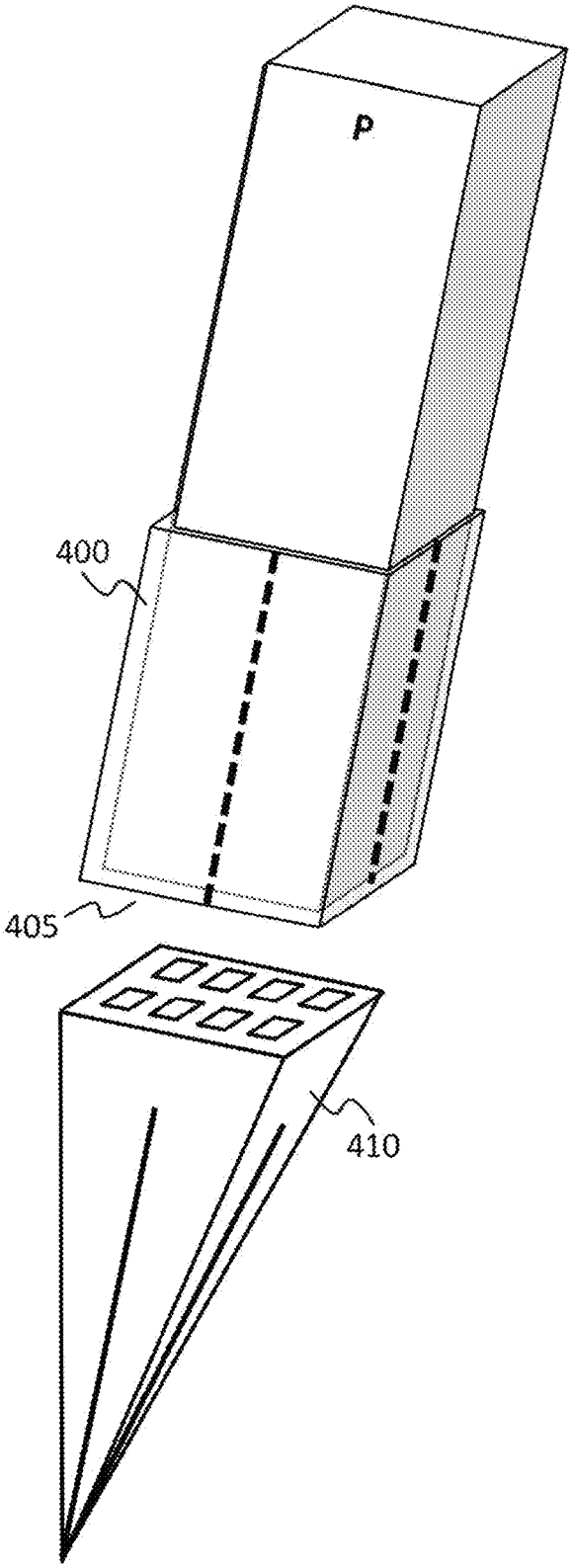
FIG. 4A is a schematic illustration of an embodiment on the assembly of the socket.

FIG. 4A is a schematic illustration of an embodiment on the assembly of the socket. Post P is inserted into the socket. It demonstrates an attachment of a wedge 410 to the socket base 405 of the socket. If the socket is driven to penetrable ground such wedge 410 may be used. Because the wedge 410 is removably connectable, different tilt or height compensation means may be arranged between the socket base 405 and the wedge 410.

Figure 4B:
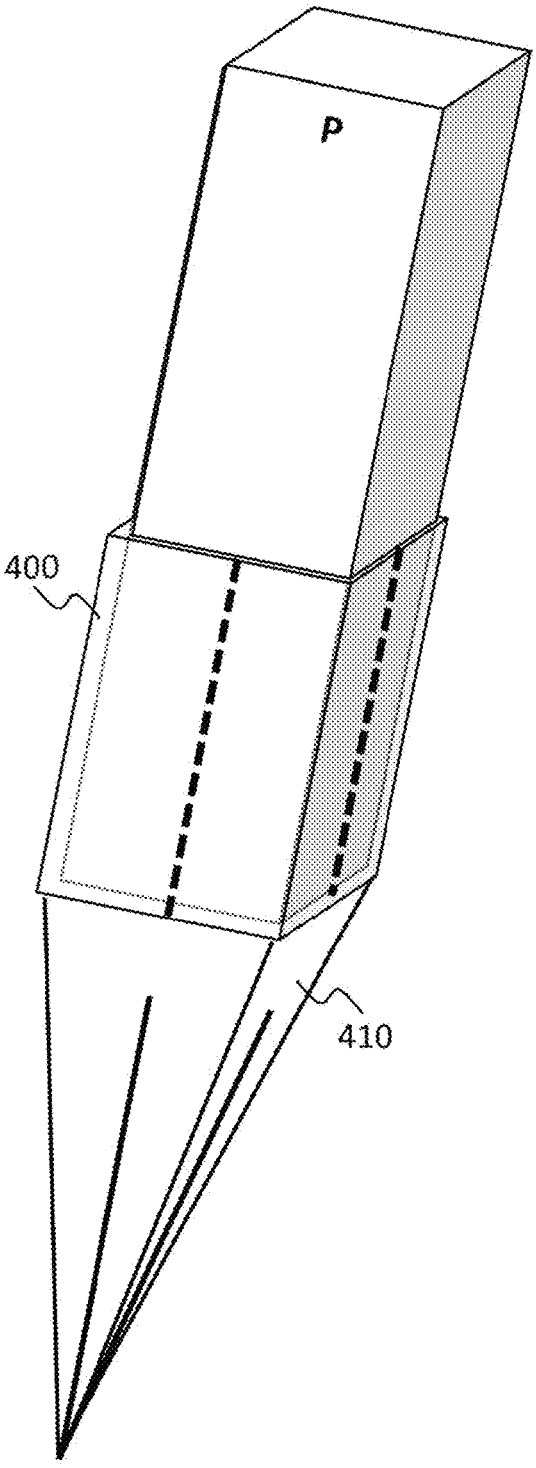
FIG. 4B is a schematic illustration of an embodiment on the assembly of the socket.

FIG. 4B is a schematic illustration of an embodiment on the assembly of the socket. Post P is inserted into the socket. It demonstrates a permanent attachment of a wedge 410 onto the socket. If the ground anchor is driven to penetrable ground such wedge may be used. The wedge 410 may be welded to the socket.

Figure 5:
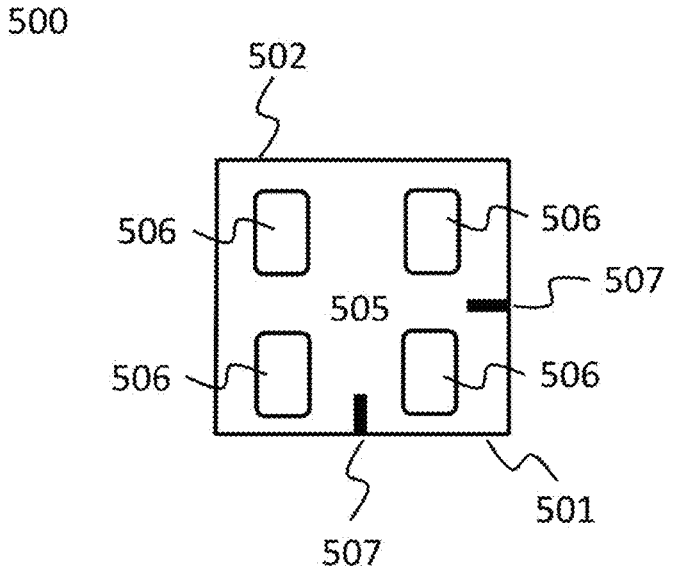
FIG. 5 is a top view of an embodiment of the socket.

FIG. 5 is a top view of an embodiment of the socket 500. It demonstrates the parts 501, 502 forming a post receiving section and the inward bent flanges 507. Openings 506 allow water passage through the base 505 of the socket 500. Additionally, the openings 506 may be used for fastening the socket 500 onto a rigid surface.

Figure 6:
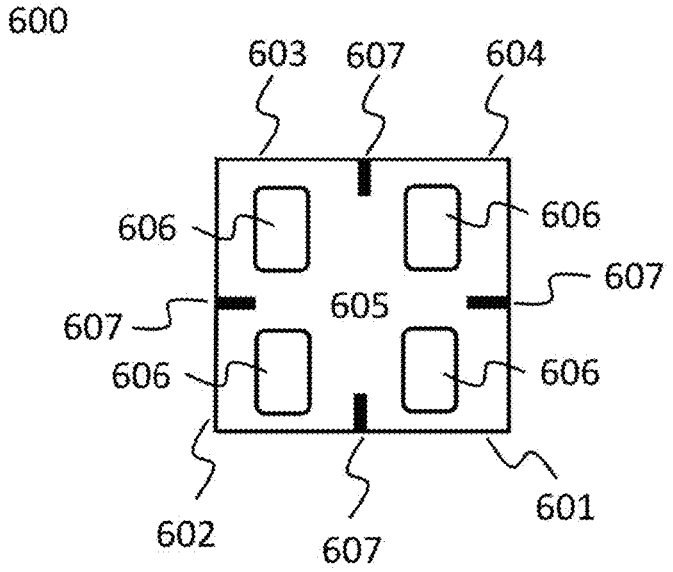
FIG. 6 is a top view of an embodiment of the socket.

FIG. 6 is a top view of an embodiment of the socket 600. It demonstrates the parts 601, 602, 603, 604 forming a post receiving section and the inward bent flanges 607. Openings 606 allow water passage through the base 605 of the socket 600. Additionally, the openings 606 may be used for fastening the socket 600 onto a rigid surface.

What is claimed is:

1. A socket comprising socket walls and a socket base arranged to receive a post, wherein the socket walls are formed of two or more solid, continuous wall parts, wherein each solid, continuous wall part comprises at least one vertical bend forming a corner and two free ends, the two free ends being arranged to extend to 20-80% of a total width of the socket in a horizontal direction;

one free end of each solid, continuous wall part comprises a fold being arranged to form a solid, inward facing flange;

each solid, continuous wall part is connected from an unbent free end to a root of the solid, inward facing flange of another solid, continuous wall part so that the solid, inward facing flanges are arranged to point towards an interior space of the socket; and the socket base being connected via welding to the socket.

2. The socket according to claim 1, wherein the solid, continuous socket walls are arranged according to the angles of the receivable post.

3. The socket according to claim 1, wherein the socket comprises a removable connection between a ground engaging wedge and the socket base.

4. The socket according to claim 1, wherein the socket is of metal.

5. The socket according to claim 1, wherein the socket is of sheet metal.

6. The socket of claim 5, wherein the sheet has a thickness of 1.5-2.0 mm.

7. The socket of claim 5, wherein the sheet metal is galvanized steel sheet, or stainless-steel sheet.

8. The socket according to claim 1, wherein the solid, continous socket wall parts are connected together via welding.

9. The socket according to claim 1, wherein the socket base has one or more openings.

10. The socket according to claim 1, wherein the socket wall is formed of two solid, continuous wall parts.

11. The socket according to claim 1, wherein the socket wall is formed of four solid, continuous wall parts.

12. The socket according to claim 1, wherein the solid inward facing flanges have a width of 5-15 mm.

13. A method to form the socket of claim 1, wherein the method comprises the steps of:

a) folding a first vertical end of a first solid, continuous wall part to form a first solid flange, and folding a second vertical end of a second solid, continuous wall part to form a second flange;

b) connecting the first and the second solid, continuous wall parts together by connecting the first solid flange formed on the first solid, continuous wall part with a non-folded vertical end of the second solid, continuous wall part;

c) optionally connecting further solid, continuous wall parts by connecting a solid flange of a next solid, continuous wall part to a vertical non folded end of a previous solid, continuous wall part;

d) forming the socket having multitude of solid flanges pointing to an interior space of the socket by connecting the solid flange formed on a last of connected solid, continuous wall parts to the non-folded vertical end of the first solid, continuous wall part; and e) connecting the socket base to a lower part of the socket formed by lower ends of the solid wall parts.

14. The method of claim 13, wherein the solid, continuous wall parts are connected together by welding.

15. The method of claim 13, wherein the method comprises providing two socket solid, continuous wall parts.

16. The method of claim 13 comprising providing four solid, continuous socket wall parts.

17. The method of claim 13, wherein the solid, continuous socket wall parts are of metal sheet having a thickness of 1.5 to 2.0 mm.

18. The method of claim 13, wherein the width of the solid flanges pointing to the interior space of the socket is 10-15 mm.

* * * * *